US007163021B1

(12) United States Patent
Matsushita

(10) Patent No.: US 7,163,021 B1
(45) Date of Patent: Jan. 16, 2007

(54) ANCHOR PEG

(75) Inventor: Paul Matsushita, 1036 No. Workman St., San Fernando, CA (US) 91340

(73) Assignee: Paul Matsushita, San Fernado, CA (US)

( * ) Notice: Subject to any disclaimer, the term of this patent is extended or adjusted under 35 U.S.C. 154(b) by 99 days.

(21) Appl. No.: 11/150,495

(22) Filed: Jun. 10, 2005

Related U.S. Application Data

(60) Provisional application No. 60/582,981, filed on Jun. 28, 2004.

(51) Int. Cl.
*E04H 15/62* (2006.01)
*E02D 5/80* (2006.01)

(52) U.S. Cl. ..... 135/118; 52/155; 52/163; 119/786

(58) Field of Classification Search ..... 52/155, 52/158, 162, 163; 119/786, 790; 135/118; 248/85, 87, 156, 530
See application file for complete search history.

(56) References Cited

U.S. PATENT DOCUMENTS

| | | | | | |
|---|---|---|---|---|---|
| 217,004 | A | * | 7/1879 | Elmer | 119/790 |
| 362,183 | A | * | 5/1887 | Runyon | 52/162 |
| 1,087,567 | A | * | 2/1914 | Bartosz | 119/790 |
| 1,189,787 | A | * | 7/1916 | Caddy | 52/160 |
| 1,940,430 | A | * | 12/1933 | Augusto | 52/160 |
| 2,713,327 | A | * | 9/1955 | Binkley | 119/790 |
| 2,867,041 | A | * | 1/1959 | Campbell | 33/228 |
| 2,889,838 | A | * | 6/1959 | Zvi et al. | 135/154 |
| 4,429,727 | A | * | 2/1984 | Wilson | 144/195.5 |

* cited by examiner

*Primary Examiner*—Robert Canfield

(57) ABSTRACT

An anchor peg includes a pointed body and a collar with an open recess and having an open-sided slot extending from the recess to the body midsection. An impact member occupies the body slot and is retained on the body by a pivot adjacent to the collar which passes through an open-sided member slot in the impact member. The member slot is closed at its opposite ends so that the impact member is deployable from the body slot into a position normal to the longitudinal axis of the body for twisting or pulling to extract the peg. A rounded end of the impact member mates with a rounded body slot end so that impacts at the opposite end of the impact member are applied directly to the body at its midsection.

16 Claims, 2 Drawing Sheets

ANCHOR PEG

Priority Claimed on Provisional Ser. No. 60/582,981 filed Jun. 28, 2004 PENDING

BACKGROUND OF THE INVENTION

1. Field of the Invention

The present invention relates to the field of hold down devices, and more particularly to a novel anchor peg or pin having a peg body pivotally mounting an impact member which may be utilized for forcibly installing the peg into the ground or other holding member and is also useful in a pivoted position for withdrawing or extracting the pin from the holder member.

2. Brief Description of the Prior Art

In the past, it has been the conventional practice to employ pins, stakes or the like as hold down devices for anchoring ropes, lines or other structures to a holding member, such as the ground. Such conventional devices are usually of one piece construction and are hammered into the ground by impacting an exposed end of the pin or stake while an opposite pointed end is driven into the holding member, such as the ground. Striking or impacting the exposed end of the pin or stake with a hammer, mallet or other hammering device usually causes the stake to split or causes the impact end to flare, crack and, therefore, limit the life and use of the pin or stake. Also, generally a hook is provided on such a pin or stake to which lanyards, ropes or other tie down equipment is attached that is intended to be anchored to the holding member or ground. Also, such hooks are not considered a positive attachment means since cords or lines can readily slip from under the hook.

Also, a variety of conventional stakes, tent pins or the like require separate tools for installation and/or removal.

Therefore, a long-standing need has existed to provide a hold down peg or pin for anchoring lanyards, lines or cords that will readily receive impact loads for driving the peg into a holding member so that the peg is not damaged, destroyed or cracked. Also, it is important that such a peg include means for extracting the pin from the holding member, be it the ground or other anchoring medium. Further, such a pin should have the capability for positively attaching a rope, cord, chain or the like to the peg so that structures intended to be anchored can be readily attached to the peg.

SUMMARY OF THE INVENTION

Accordingly, the above problems and difficulties are avoided by the present invention which provides a novel anchor peg that includes an elongated body pointed at one end and which includes a collar at its upper end defining an open recess and further defining an open-sided body slot extending from the recess to the midsection of the body. An impact member occupies the body slot and is rotatably retained on the body by means of a pivot extending through the body immediately adjacent to the collar and which passes through an open-sided slot in the impact member. The member slot is closed at its opposite ends so that the impact member can be deployed from the slot in the body into a position normal to the longitudinal axis of the body so that the user can grasp the impact member for readily twisting or pulling procedures in order to extract or withdraw the peg from a holding member. A feature of the inventive peg resides in a rounded end of the impact member which mates with a rounded end of the body slot in order that impacts from a hammer head at the opposite end of the impact member will be applied directly to the body at its midsection rather than at the end of the body with the collar. In combination with this feature, the hammer or impact head on the impact member does not touch nor engage with the bottom of the open recess surrounded by the collar so that no impact forces or loads are introduced to the body at this juncture.

Therefore, it is among the primary objects of the present invention to provide a novel anchor pin which provides a pivoting means so that the user may readily extract or withdraw the anchor pin from its holding member by either pulling or twisting or combination of either procedure.

Another object of the present invention is to provide a novel anchor peg having a body which includes an impact member that applies impact loads to the midsection of the body carrying the impact member whereby load forces are directly placed into the body for driving the body into a holding member.

Yet another object of the invention resides in providing an impact member which is pivotally carried on the exposed end of an anchor body that may be rotated to several positions in order to effectively withdraw or extract the anchor pin from a holding member.

A further object resides in providing an elongated peg body having an impact member pivotally carried thereon that is deployable into a hammering position for forcibly urging the peg body into the ground or into a peg body extraction position for withdrawing the peg body from the ground.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figure 1:
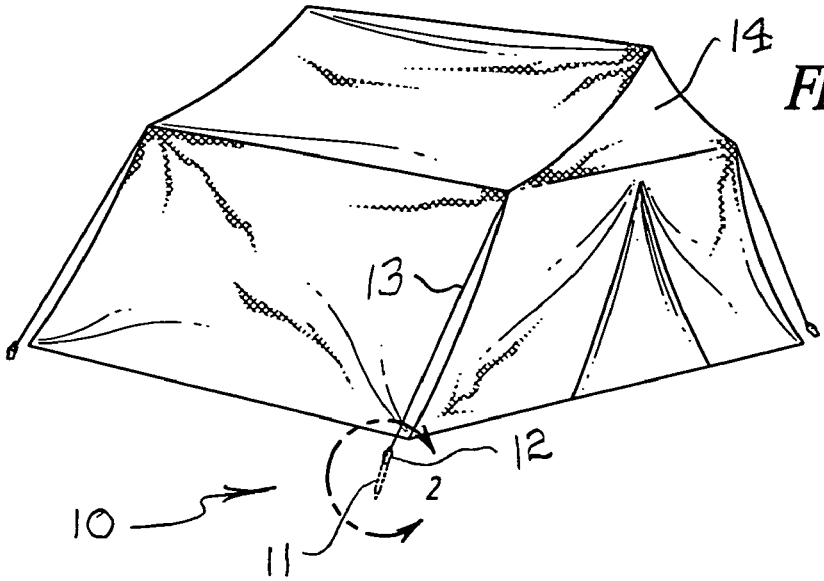
FIG. 1 is a perspective view of the anchor peg or pin incorporating the present invention for holding a structure in a secure position.

Referring to FIG. 1, the novel anchor peg of the present invention is illustrated in the general direction of arrow 10 and includes a body 11 which is embedded in the ground or other holding material or member. An impact member 12 outwardly projects from one end of the body 11 and is readily attached and detached to the end of a cord, line, chain or rope, as indicated by numeral 13. The anchor peg is intended to support an item such as a tent 14 or any other article which requires such support.

Figure 2:
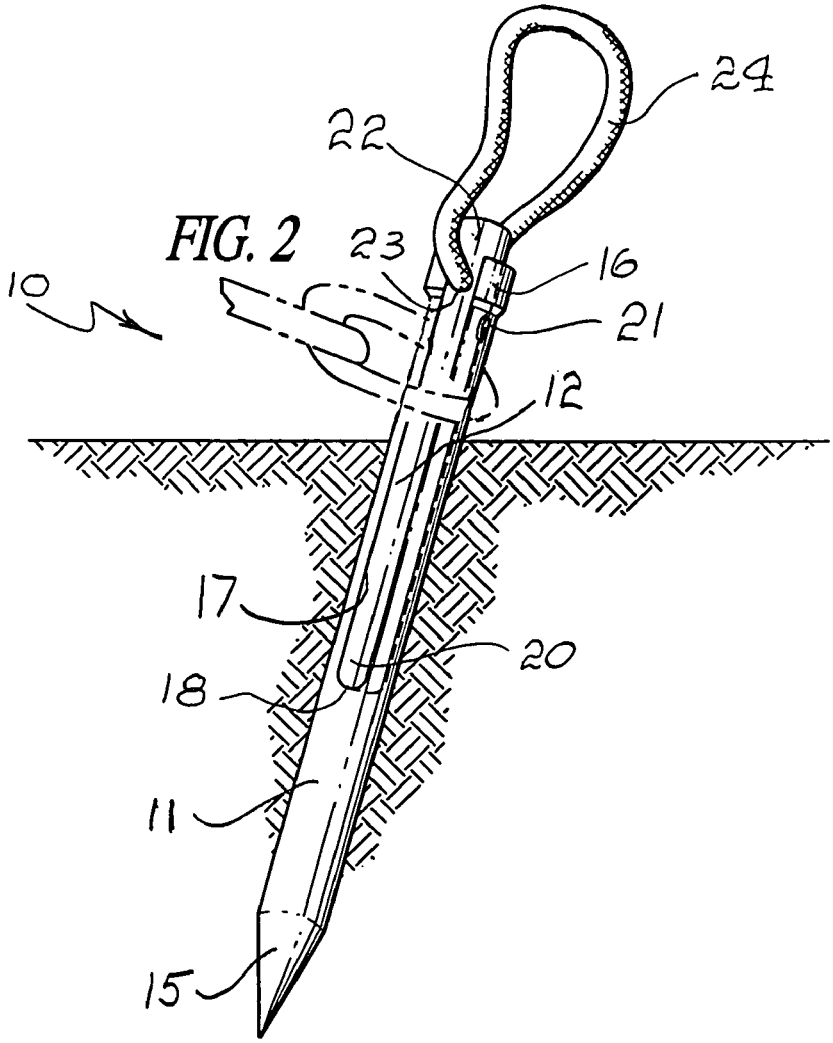
FIG. 2 is a greatly enlarged perspective view of the anchor peg or pin shown in FIG. 1 taken in the direction of arrows 2—2.

Referring now to FIG. 2, it can be seen that the anchor body 11 is embedded into the ground as a holding member and that one end of the elongated body is a pointed end 15 while the opposite end terminates in a circular collar 16. The body 11 is provided with an open-sided slot 17 that is open ended at the collar 16 and is closed at an impact surface 18 midway between the opposite ends of the body 11. The impact surface 18 is rounded so as to accept the round end 20 of the impact member 12. Also, it is noted that a pivot pin 21 is located immediately adjacent the collar 16 and that it is transversely installed on the body so as to pass through the impact member 12. Also, the impact member 12 includes an impact or hammer head 22 as well as an open ended hole 23 through which a cord is looped and identified by numeral 24. The chain, line or the like 13 may readily be attached or detached to the body 11. The loop may be employed for withdrawing the anchor peg from its holding member when lesser force is required for withdrawal. The head 22 resides in a recess 26, shown in FIG. 4, surrounded by collar 16.

Figure 3:
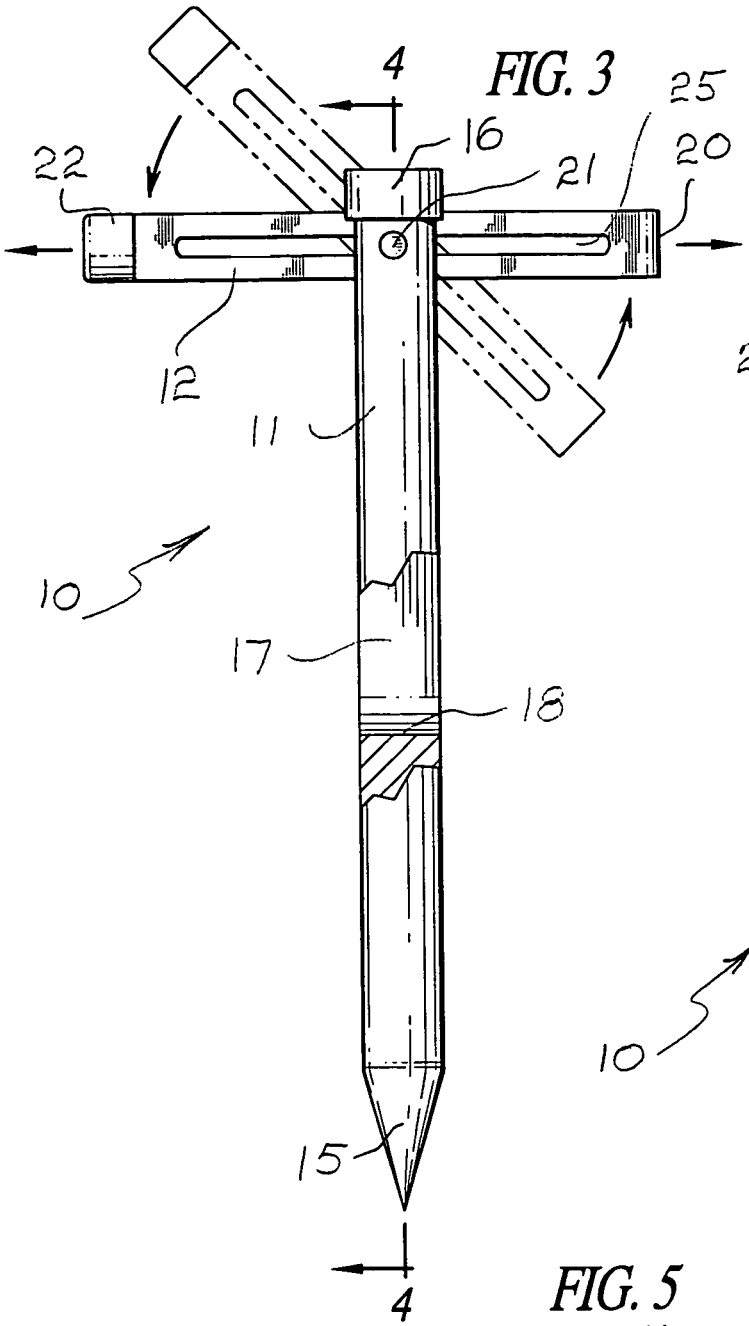
FIG. 3 is a side elevational view of the anchor pin illustrating the impact member in position for extracting or withdrawing the pin from a holding member.

Referring now to FIG. 3, it can be seen that the slot 17 terminates at the midsection of the body with the impact surface 18 and it can also be seen that the impact member 12, when used for withdrawal purposes, has been pivoted on pivot 21 so that the longitudinal axis of the impact member is perpendicular to the longitudinal axis of the body 11. The impact member 12 may be slid along the pivot 21 since the pivot resides within an elongated slot 25.

Figure 4:
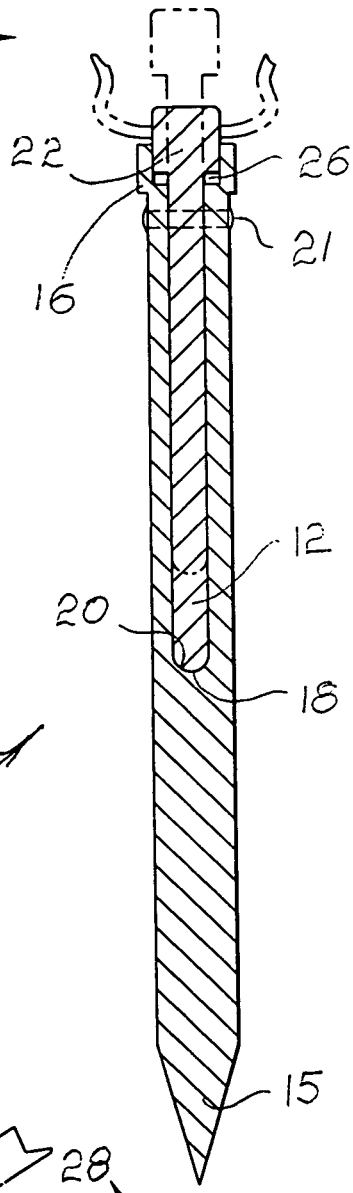
FIG. 4 is a longitudinal cross-sectional view of the anchor pin shown in FIG. 3 as taken in the direction of arrows 3—3 thereof.

Referring now in detail to FIG. 4, it can be seen that the impact end 20 of the impact member conforms to the rounded configuration of the impact surface 18 so that load forces applied to the head 22 of the impact member will be applied directly to the body 11 for driving the pointed end 15 into the holding member. Also, it is to be noted that the head 22 does not touch or engage with the body 11 as it enters and partially occupies the recess 26 defined by the circular collar 16.

Also, the pivot pin 21 passes through the body 11 close to the collar 16 and passes through the slot 25. This portion of the head 22 resides above the collar 16.

Figure 5:
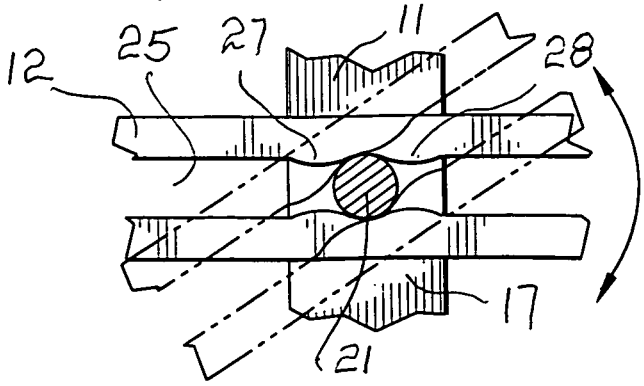
FIG. 5 is a transverse cross-sectional view of the impact member illustrating deployment or rotation of a member with respect to the peg or pin body.

Referring now to FIG. 5, it can be seen that the arm or impact member 12 can be rotated about the pin 21 within the slot 25. The impact member 12 can rotate from the solid line position to the broken line position within the slot 17 as illustrated in FIG. 3 as well as FIG. 5. In order to maintain the pivot pin 21 at the center of the impact member 12, detents such as detents 27 and 28 may be placed on opposite sides of the pin so as to releasably restrain the pin at the midsection thereof.

In view of the foregoing, it can be seen that the anchor peg of the present invention provides a novel means for holding lines, chains, or the like into a holding medium such as the ground, wood or the like. Also, for withdrawal purposes the impact member 12 may be rotated to the position shown in solid lines in FIG. 3 and grasped by the fingers of the user for extraction from the holding member. For installing the anchor peg, the impact member is placed in the position shown in FIG. 4 so that the surfaces 20 and 18 engage whereby load forces from the impact head 22 are applied through the impact member directly to the body 11 for driving the pointed end 15 into the holding member.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An anchor peg comprising:

an elongated body with a pointed end and a recessed end separated by a midsection;

an open-sided slot provided in said body extended from said recessed end through said midsection;

an impact member pivotally carried on said body having a first position occupying said open-sided slot and a second position perpendicular to said open-sided slot;

an impact head on said impact member projecting outwardly from said recessed end when said impact member is in said first position; and said impact member having a rounded end engageable with an end of said open-sided slot for conducting impact loads into said body in response to impacting said impact head.

2. The anchor peg defined in claim 1 wherein:

a pivot connection adjacent said recessed end for pivotally connecting said impact member with said body.

3. The anchor peg defined in claim 2 wherein:

said impact member constitutes a handle for grasping to extract said body.

4. The anchor peg defined in claim 3 wherein:

said recessed end includes an open recess defined by a circular collar for partial occupation by said impact head when said impact member is in said first position.

5. The anchor peg defined in claim 4 including:

a closed ended slot in said impact member for slidably receiving said pivot connection.

6. An anchor peg comprising:

an elongated body having a pointed end and an end provided with an open recess;

an impact member pivotally carried on said body having a first position for imparting impact loads into said body and a second position normal with respect to said body for extracting said body; and said impact member having an impact head partially occupying said open recess with a portion of said impact head outwardly projecting from said body to directly receive impact loads.

7. The anchor peg defined in claim 6 including:

a pivot connection mounting said impact member with said body.

8. The anchor peg defined in claim 7 including:

said impact member having an elongated closed-ended slot; and said pivot connection passing through said closed-ended slot whereby said impact member is rotatable on said pivot connection for deployment to either said first position or said second position.

9. The anchor peg defined in claim 8 wherein:

said impact head includes an open-ended bore; and a cord loop disposed through said bore.

10. The anchor peg defined in claim 9 wherein:

said impact member includes a pair of opposing lobes narrowing said slot to yieldably resist passage of said pivot connection therebetween.

11. The anchor peg defined in claim 10 wherein:

said body includes a circular collar defining said open recess and pivotally including said impact head when said impact member is in said first position.

12. An anchor peg comprising:

an elongated pointed body having an open-ended slot being open at one end and closed at an other end midway between opposite ends of said body;

said other end of said slot constituting an impact load distributing area of said body;

an impact member slidably disposed in said open-sided slot and provided with an impact load transferring area that is engageable with said impact load distributing area; and said impact member further having an impact head outwardly projecting from said one end of said body.

13. The anchor peg defined in claim 12 wherein:

said impact member being adapted to receive impact loads on said impact head and for transferring impact loads through engagement of said impact load transferring area to said impact distributing area.

14. The anchor peg defined in claim 13 wherein:

said body includes a circular collar defining an open recess partially occupied by said impact head.

15. The anchor peg defined in claim 14 wherein:

said impact member has a first position with said impact transferring area in contact with said impact distributing area and a second position with said impact member deployable into a position perpendicular to said body.

16. The anchor peg defined in claim 15 including:

a pivot pin secured to said body through said collar and rotatably mounting said impact member with said body.

* * * * *